United States Patent [19]

Bernat

[11] Patent Number: 4,780,942

[45] Date of Patent: Nov. 1, 1988

[54] FUEL INJECTOR PULLER

[76] Inventor: Helmut R. Bernat, 7122 Sanford Ct., Annandale, Va. 22003

[21] Appl. No.: 14,231

[22] Filed: Feb. 12, 1987

[51] Int. Cl.[4] ..... B66F 15/00

[52] U.S. Cl. ..... 29/219; 29/267

[58] Field of Search ..... 254/25, 28, 131; 29/267, 270, 278, 280, 219, 282

[56] References Cited

U.S. PATENT DOCUMENTS

| | | | |
|---|---|---|---|
| 436,157 | 9/1890 | Slocom | 254/25 |
| 1,163,018 | 12/1915 | Knutson | 29/219 |
| 1,372,389 | 3/1921 | Bailey et al. | 29/267 |
| 2,018,902 | 10/1935 | Schwedland | 29/267 |
| 3,295,193 | 1/1967 | Maness | 29/220 |
| 3,873,067 | 3/1975 | Carpio et al. | 29/219 |
| 3,985,338 | 10/1976 | Herrmann | 254/131 |
| 4,201,368 | 5/1980 | Vetter | 254/131 |

FOREIGN PATENT DOCUMENTS

| | | | |
|---|---|---|---|
| 185679 | 9/1922 | United Kingdom | 29/267 |

*Primary Examiner*—Robert C. Watson
*Attorney, Agent, or Firm*—Neil F. Markva

[57] ABSTRACT

A hand tool for pulling a fuel injector outwardly from a seated location in an engine. The tool comprises an elongated shaft portion having a handle at one end thereof, a gripping section at the other end thereof and a push support means located at an intermediate point between the handle and the gripping section. The handle has a size and shape to facilitate the hand gripping thereof. The gripping section includes a reaching portion extending outwardly from the end of the shaft portion and a part-engaging portion extending away from a distal end of the reaching portion. The push support means extends outwardly from the shaft portion to provide a fulcrum pivot point about which the handle and gripping section pivot. The part-engaging portion is shaped to grasp the part to be pulled outwardly from the seated location when a force is applied to the handle in a direction to cause relative movement of the part-engaging portion with respect to the fulcrum pivot point.

6 Claims, 2 Drawing Sheets

10
12
11
16
18
21
24
13
23
17
26
22
15
25
20

FUEL INJECTOR PULLER

FIELD OF THE INVENTION

This invention relates to a hand tool for pulling a part outwardly from a seated location. More particularly, the hand tool of the invention is adapted to remove fuel injectors from engines equipped with a Robert Bosch K-Jetronic Fuel Injection System.

BACKGROUND OF THE INVENTION

The removal of fuel injectors from an engine for cleaning, replacement of the injector seal or the injector itself proves quite difficult because of its location on the engine. A particular difficulty is encountered when removing fuel injectors from engines equipped with a Robert Bosch K-Jetronic Fuel Injection System.

The present normal procedure for removing such a fuel injector requires the mechanic to place a specially designed tool behind the injector and then pry the injector out with a screwdriver. Such a prior art method is not practical because the injector is obstructed by fuel lines, vacuum hoses and other fuel injection parts. Furthermore, the mechanic may burn his hands on the manifold of the engine when it is necessary to pry the injector out using prior art devices.

The fuel injector removing tool as disclosed in the U.S. Pat. No. 4,293,992 is particularly useful for removing fuel injectors from diesel engines. This prior art device comprises an elongated member threaded at one end to engage similiar threads in an injector engaging member. A locating pin is adapted to fit inside a bolt hole alongside a fuel injector in a diesel engine. The locating pin serves as a pivot for the mechanic to manually lever the injector loose from the diesel engine.

Thus, this known tool is necessarily dependent upon the structure of the cylinder head having threaded bores adjacent the fuel injector mechanism. Such a prior art tool is ineffective when attempting to pull fuel injectors such as those forming a part of a Robert Bosch K-Jetronic Fuel Injection System where no such threaded bores exist.

SUMMARY OF THE INVENTION

The primary object of the invention is to provide a simple, easy-to-use tool for removing fuel injectors seated in a cylinder head equipped with a Robert Bosch K-Jetronic Fuel Injection System without damaging an adjacent part of the engine or the user's hands.

The hand tool as described herein comprises an elongated shaft portion including a handle at one end thereof, a gripping section at the other end thereof and support means located at an intermediate point between the handle and the gripping section. The handle has a size and shape to facilitate the hand gripping thereof.

The gripping section includes a reaching portion extending outwardly from the end of the shaft portion and a part-engaging portion extending away from a distal end of the reaching portion. The support means extends outwardly from the shaft portion to provide a fulcrum point between the handle and the gripping section. The part-engaging portion is shaped to contact the part to be pulled outwardly from the seated location when a force is applied to the handle in a direction to cause relative movement of the part-engaging portion with respect to the fulcrum pivot point.

A specific feature of the invention is directed to a part-engaging portion having a bifurcated, U-shaped structure effective to contact opposing sides of the fuel injector being pulled. The part-engaging portion is designed to hook the injector with its U-shaped claw structure into a groove structure under the injector lip.

The support means comprises a projecting element having an outer end portion which engages the engine at a location such as the valve cove. The contact point at the outer end of the projecting element provides a fulcrum pivot point so that when a downward force is applied on to the handle, the part-engaging portion under the lip of the injector moves upwardly about the fulcrum pivot point to thereby remove the fuel injector from the cylinder head.

Another feature of the invention is directed to the structure of the reaching portion which is disposed at a reaching angle with respect to the shaft portion. The part-engaging portion is disposed at a grasping angle with respect to the reaching portion. The reaching portion is disposed to extend in a direction outwardly from the shaft portion on the same side of the shaft portion as the push support means. The part-engaging portion extends in a direction rearwardly with respect to the shaft portion. The reaching angle has a size effective to extend the reaching portion downwardly to a point adjacent the fuel injector in its seated location. The grasping angle has a size effective to direct the part-engaging portion inwardly for contact with the fuel injector in its seated location.

BRIEF DESCRIPTION OF DRAWINGS

Other objects of this invention will appear in the following description and appended claims, reference being made to the accompanying drawings forming a part of the specification wherein like reference characters designate corresponding parts in the several views.

DETAILED INVENTION

Figure 1:
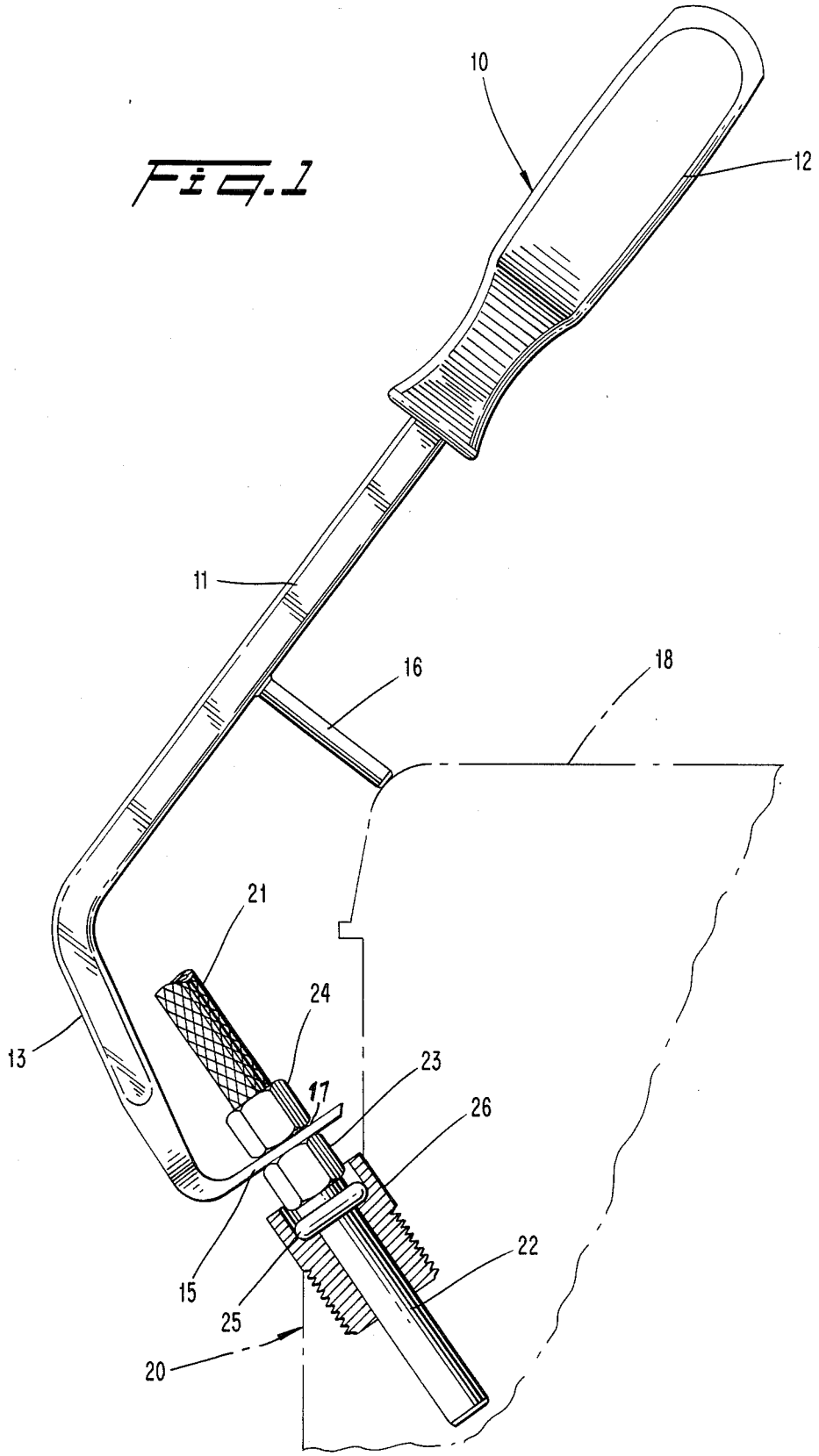
FIG. 1 is an elevational view showing the disposition of the fuel injector puller according to the invention with respect to the from which a fuel injector is being pulled.
Figure 2:
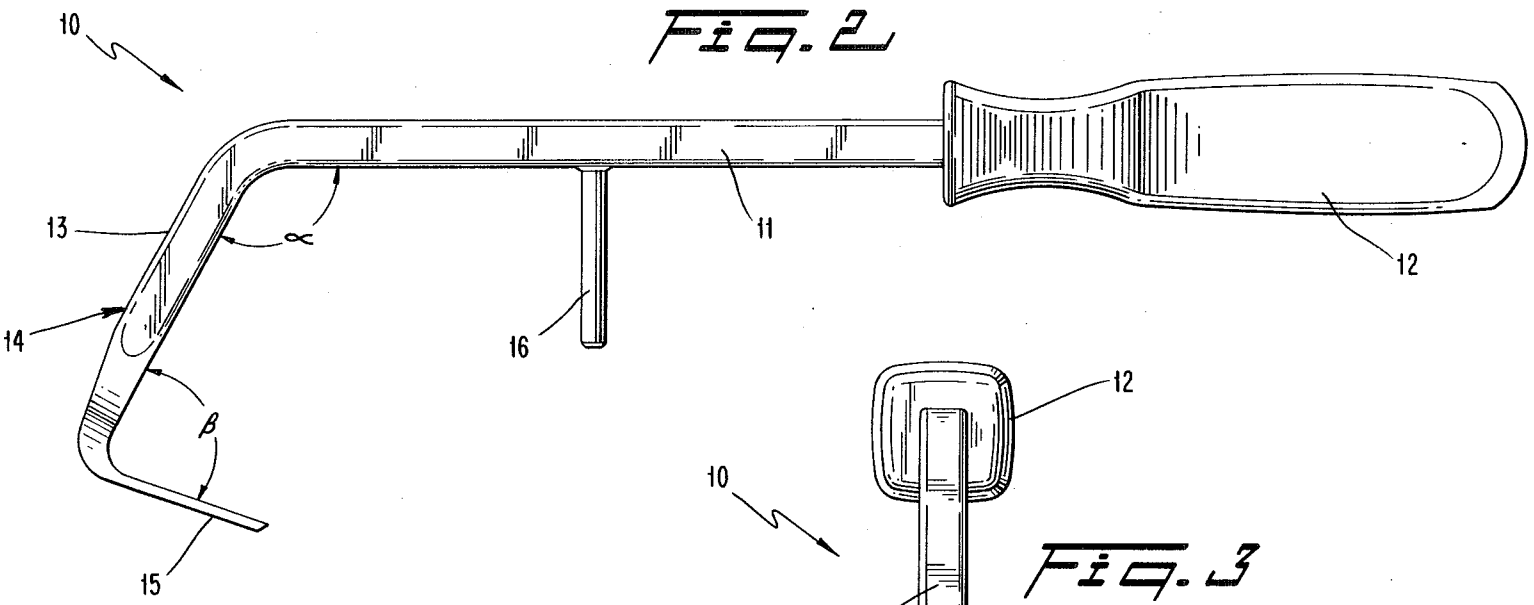
FIG. 2 is a side elevational view of a fuel injector puller according to the invention.
Figure 3:
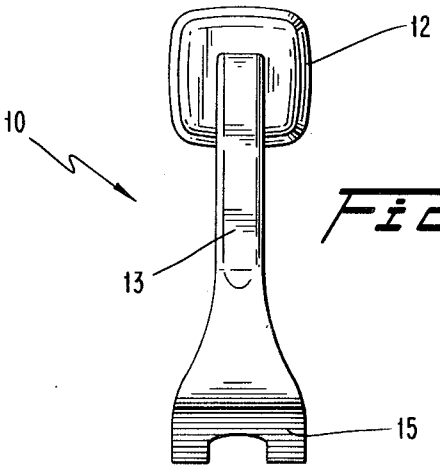
FIG. 3 is a bottom view of the fuel injector puller as shown in FIG. 2.
Figure 4:
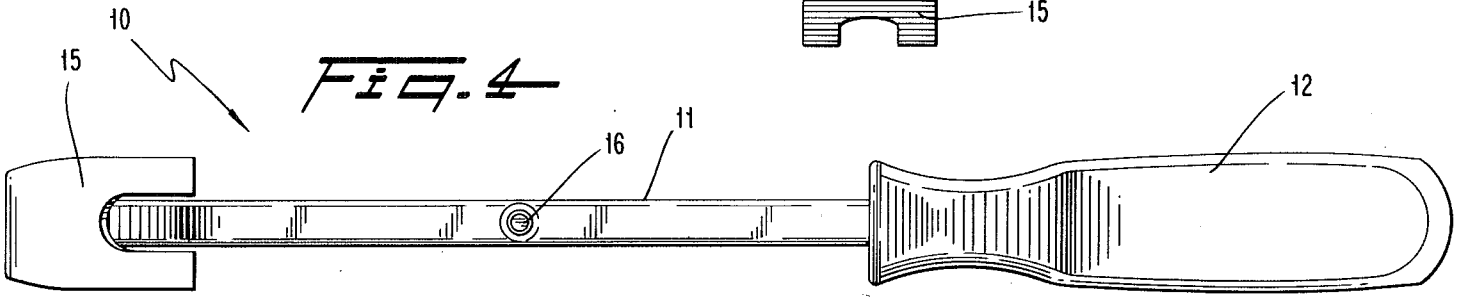
FIG. 4 is a front view of the fuel injection puller as shown in FIG. 2.

The hand tool puller, generally designated 10, includes an elongated shaft portion 11 including a handle 12 at one end thereof, a gripping section, generally designated 14, at the other end thereof and a push support element 16 located at an intermediate point between handle 12 and gripping section 14. Handle 12 has a size and shape to facilitate the hand gripping thereof.

Gripping section 14 includes a reaching section 13 which extends outwardly from the end of shaft portion 12 at a reaching angle $\alpha$. A part-engaging section 15 extends away from the distal end of reaching section 13 at a grasping angle $\beta$. The part-engaging portion 15 has a bifurcated, U-shaped structure effective to fit into a groove 17 between an injector holding nut 23 and injector coupling threads of fuel injector 22 onto which threads screw line connector 24 is shown disposed.

Push support element 16 extends outwardly from shaft 11 and provides a fulcrum pivot point at the outer end thereof to rest against the valve cover 18 of the engine, generally designated 20.

This specfic embodiment is directed to removing a fuel injector 22 from the engine equipped with a Robert Bosch K-Jetronic Fuel Injection System. The fuel injector 22 is slidingly engaged into an injector insulator 26 and has an injector seal 25 around the outer end thereof. Screw connector 24 is disposed at the end of injector line 21 threadingly engages the injector coupling threads and allows the insertion of the bifurcated, U-shaped grip element 15 into groove 17 as shown.

Once the grip or claw element 15 is in groove 17, tool 10 is lowered to valve cover 18 on the fulcrum push support pin 16. As a force is manually applied to handle 12 in a downward direction, injector 22 is popped out of the insulator 26 because of the relative movement of the part-engaging element 15 with respect to the fulcrum pivot point at the end of push support pin 16.

In this specific embodiment, the distance between push support pin 16 and the outer end of shaft portion 11 from which the reaching section 13 extends is to $2\frac{3}{4}$ inches. The distance between the outer end of shaft 11 and the outer free end of the U-shaped grasping element 15 is $2\frac{1}{4}$ inches. The U-shaped grasping member 15 is about $1\frac{1}{8}$ inch long with the U-shaped slot being $\frac{3}{8}$ inch wide and $\frac{5}{8}$ inch deep.

The reaching angle $\alpha$ is in a range of about 115° to about 120° and in this specific embodiment is about 118°. The grasping angle $\beta$ is in a range of about 75° to about 85° and in this specific embodiment is about 81°. Reaching angle $\alpha$ is equal to an amount effective to extend reaching section 13 downwardly to a point adjacent injector 22. Grasping angle $\beta$ is equal to an amount effective to direct part-engaging element 15 inwardly for contact with groove 17.

While the fuel injector puller has been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. A hand tool for pulling a part outwardly from a seated location, said tool comprising:

(a) an elongated shaft portion including a handle at one end thereof, a gripping section at the other end thereof and push support means at an intermediate location between the handle and the gripping section, (b) the handle having the size and shape to facilitate the hand gripping thereof, (c) the gripping section including a reaching portion extending outwardly from the end of the shaft portion and a part-engaging portion extending away from a distal end of the reaching portion, (d) the push support means extending outwardly from the shaft portion to provide a fulcrum pivot point between the handle and the gripping section, (e) the part-engaging portion is disposed at a grasping angle in the range of about 75° to about 85° with respect to the reaching portion and shaped to grasp the part to be pulled outwardly from the seated location when a force is applied to the handle in a direction to cause relative movement of the part-engaging portion with respect to the fulcrum, (f) the reaching portion is disposed at a reaching angle with respect to the shaft portion, (g) the reaching angle is in the range of about 115° to about 120°.

2. The hand tool as defined in claim 1 wherein the reaching angle is about 118°.

3. The hand tool as defined in claim 1 wherein the grasping angle is about 81°.

4. A hand tool for pulling a fuel injector outwardly from a seated location in an engine, said tool comprising:

(a) an elongated shaft portion including a handle at one end thereof, a gripping section at the other end thereof and push support means at an intermediate location between the handle and the gripping section, (b) the handle having the size and shape to facilitate the hand gripping thereof, (c) the gripping section including a reaching portion extending outwardly from the end of the shaft portion and a part-engaging portion extending away from a distal end of the reaching portion, (d) the push support means including a leg member extending in a direction outwardly from the same side of the shaft portion as the reaching portion and having an outer free end to contact the engine at a location laterally spaced from the location of the fuel injector being pulled thereby providing a fulcrum pivot point between the handle and the gripping section, (e) the part-engaging portion including a bifurcated U-shaped structure effective to grasp opposing sides of the fuel injector to be pulled outwardly from the seated location when a force is applied to the handle in a direction to cause relative movement of the part-engaging portion with respect to the fulcrum, (f) the reaching portion is disposed at a reaching angle with respect to the shaft portion to extend in a direction outwardly from the shaft portion on the same side of the shaft portion as the push support means, (g) the part-engaging portion is disposed at a grasping angle with respect to the reaching portion to extend in a direction rearwardly with respect to the shaft portion.

5. The hand tool as defined in claim 4 wherein the fuel injector being pulled constitutes a Robert Bosch K-Jetronic Fuel Injection System fuel injector.

6. A hand tool for pulling a part outwardly from a seated location, said tool comprising:

(a) an elongated shaft portion including a handle at one end thereof, a gripping section at the other end thereof and push support means at an intermediate location between the handle and the gripping section, (b) the handle having the size and shape to facilitate the hand gripping thereof, (c) the gripping section including a reaching portion extending outwardly from the end of the shaft portion and a part-engaging portion extending away from a distal end of the reaching portion, (d) the push support means extending outwardly from the shaft portion to provide a fulcrum pivot point between the handle and the gripping section, (e) the part-engaging portion being shaped to grasp the part to be pulled outwardly from the seated location when a force is applied to the handle in a direction to cause relative movement of the part-engaging portion with respect to the fulcrum, (f) the reaching portion is disposed at a reaching angle to extend outwardly from the same side of the shaft portion as the push support means extends, (g) the reaching angle having a size effective to extend the reaching portion downwardly to a point adjacent the fuel injector in its seated location, (h) the part-engaging portion is disposed at a grasping angle to extend outwardly from the reaching portion and rearwardly with respect to the shaft portion, (i) the part-engaging portion extending in a direction to intersect the outward direction in which the push support means extends from the shaft portion, (j) the grasping angle having a size effective to direct the part-engaging portion inwardly for contact with the fuel injector in its seated location.

* * * * *